US007448928B2

(12) United States Patent
Hasegawa et al.

(10) Patent No.: US 7,448,928 B2
(45) Date of Patent: Nov. 11, 2008

(54) OUTBOARD MOTOR COWL STRUCTURE

(75) Inventors: Hiroyuki Hasegawa, Shizuoka-ken (JP); Hideto Arai, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 16 days.

(21) Appl. No.: 11/735,934

(22) Filed: Apr. 16, 2007

(65) Prior Publication Data

US 2007/0243776 A1 Oct. 18, 2007

(30) Foreign Application Priority Data

Apr. 14, 2006 (JP) ..... 2006-111740

(51) Int. Cl.
*B63H 20/32* (2006.01)

(52) U.S. Cl. ..... 440/77; 292/113; 292/123; 292/229; 292/247

(58) Field of Classification Search ..... 440/76, 440/77, 78; 123/195 P, 198 E; 292/106, 292/113, 121, 123, 128, 129, 207, 208, 229, 292/247

See application file for complete search history.

(56) References Cited

U.S. PATENT DOCUMENTS 4,830,413 A * 5/1989 Bisbing ..... 292/247
5,655,799 A * 8/1997 Takimoto ..... 292/113
5,667,258 A * 9/1997 Takimoto ..... 292/113
5,873,756 A * 2/1999 Takayanagi ..... 440/77

FOREIGN PATENT DOCUMENTS

JP 08/268384 10/1996

* cited by examiner

*Primary Examiner*—Lars A Olson
(74) *Attorney, Agent, or Firm*—Knobbe, Martens, Olson & Bear, LLP

(57) ABSTRACT

An outboard motor has a cowl having a top cowl and a bottom cowl that are detachably connected using a clamp apparatus. The clamp apparatus has a clamp engaging member on the top cowl, a clamp fixing member on the bottom cowl, and a clamp for connecting the top and bottom cowls. The clamp has an engaging section for engaging the clamp engaging member, a fixing section fixed on the bottom cowl by the clamp fixing member, a mounting pivot formed on the fixing section, and a supporting pivot linked to the mounting pivot. A line is defined between the engaging section and the mounting pivot. In an open clamp state, the supporting pivot is positioned away from the cowl beyond the line. In a closed clamp state, the supporting pivot is positioned adjacent to the cowl within the line. A biasing spring biases the clamp main body toward the cowl at least in the open clamp state.

9 Claims, 7 Drawing Sheets

[FIG. 1]
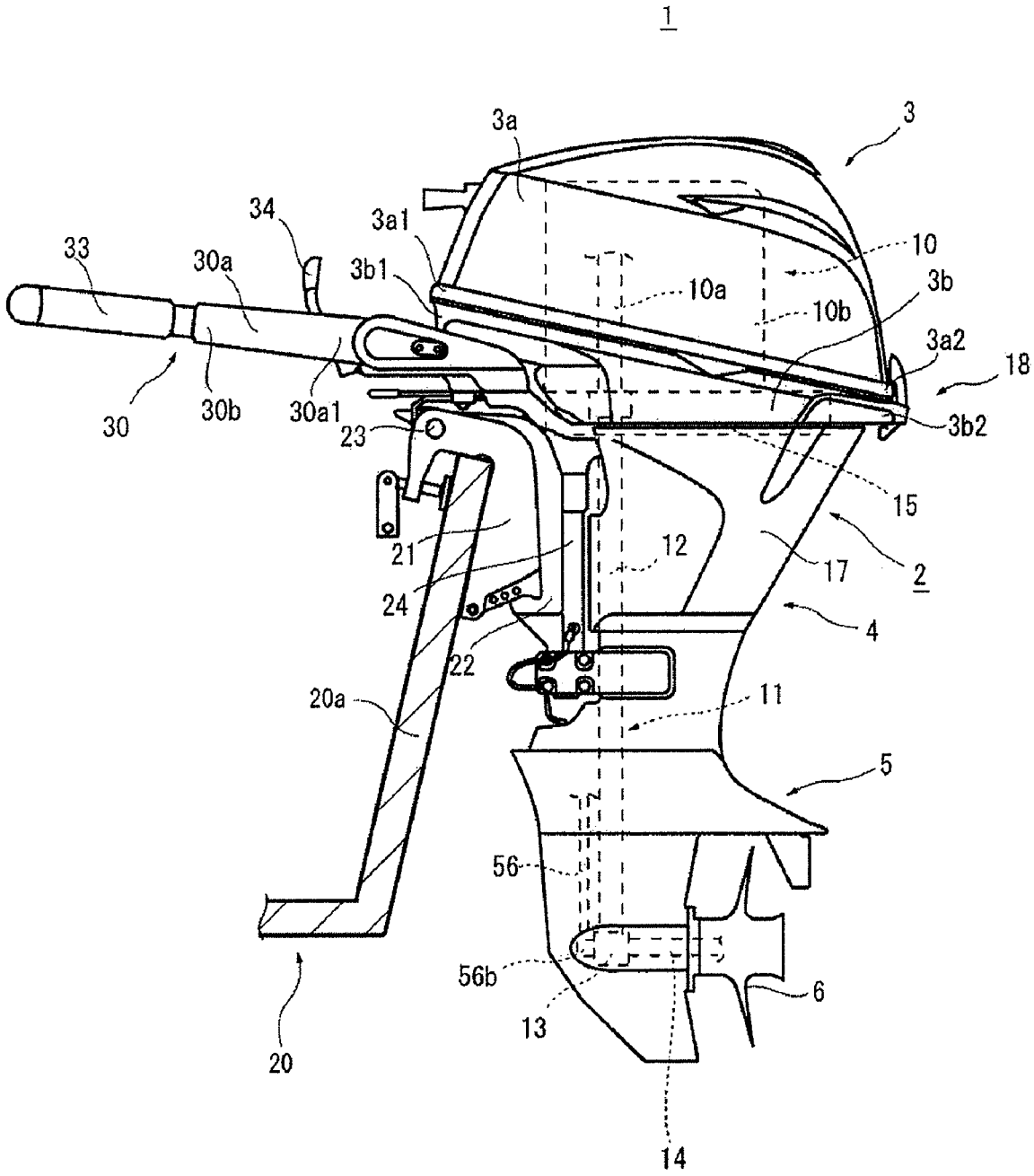

[FIG. 2]
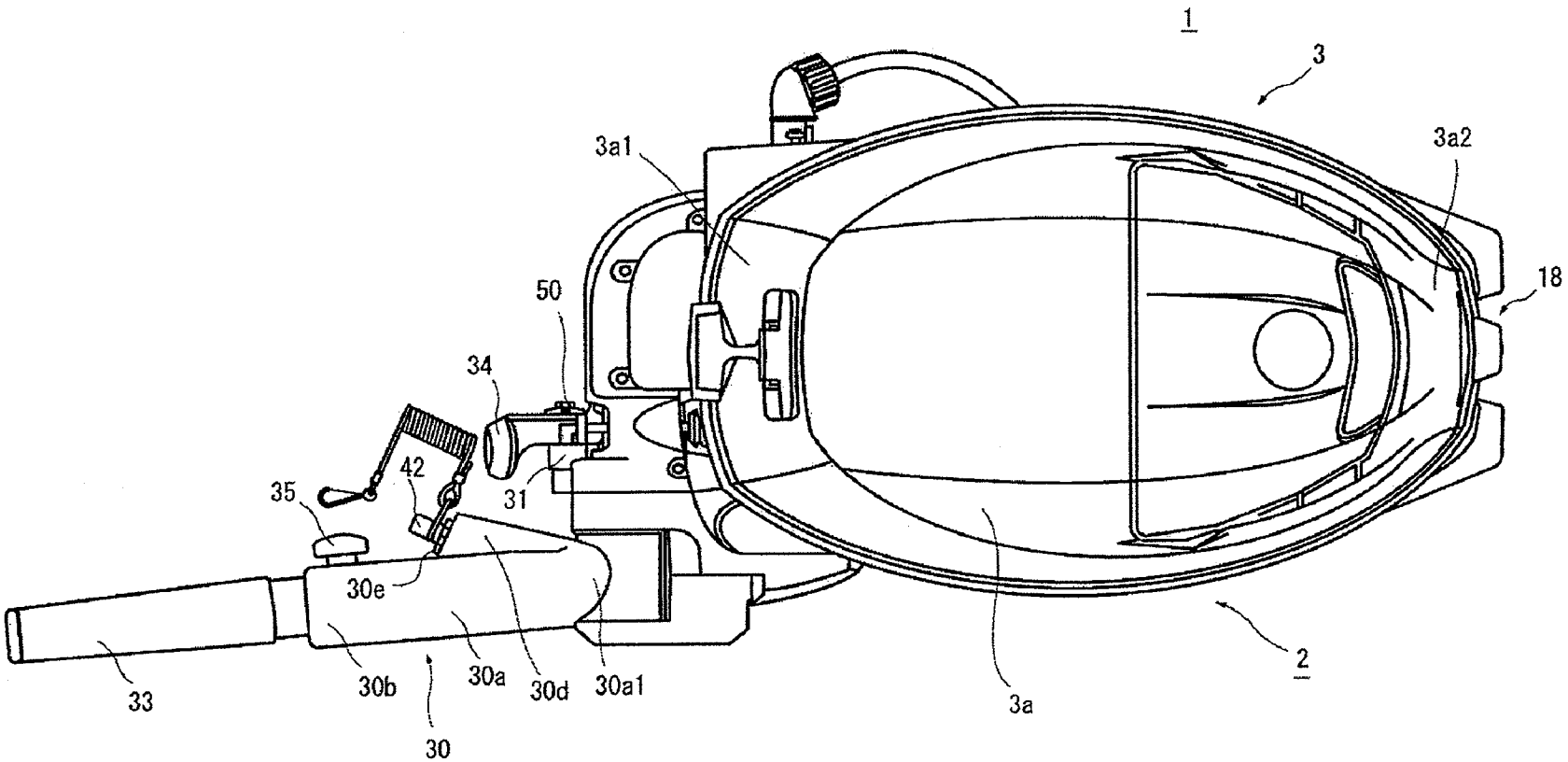

[FIG. 3]
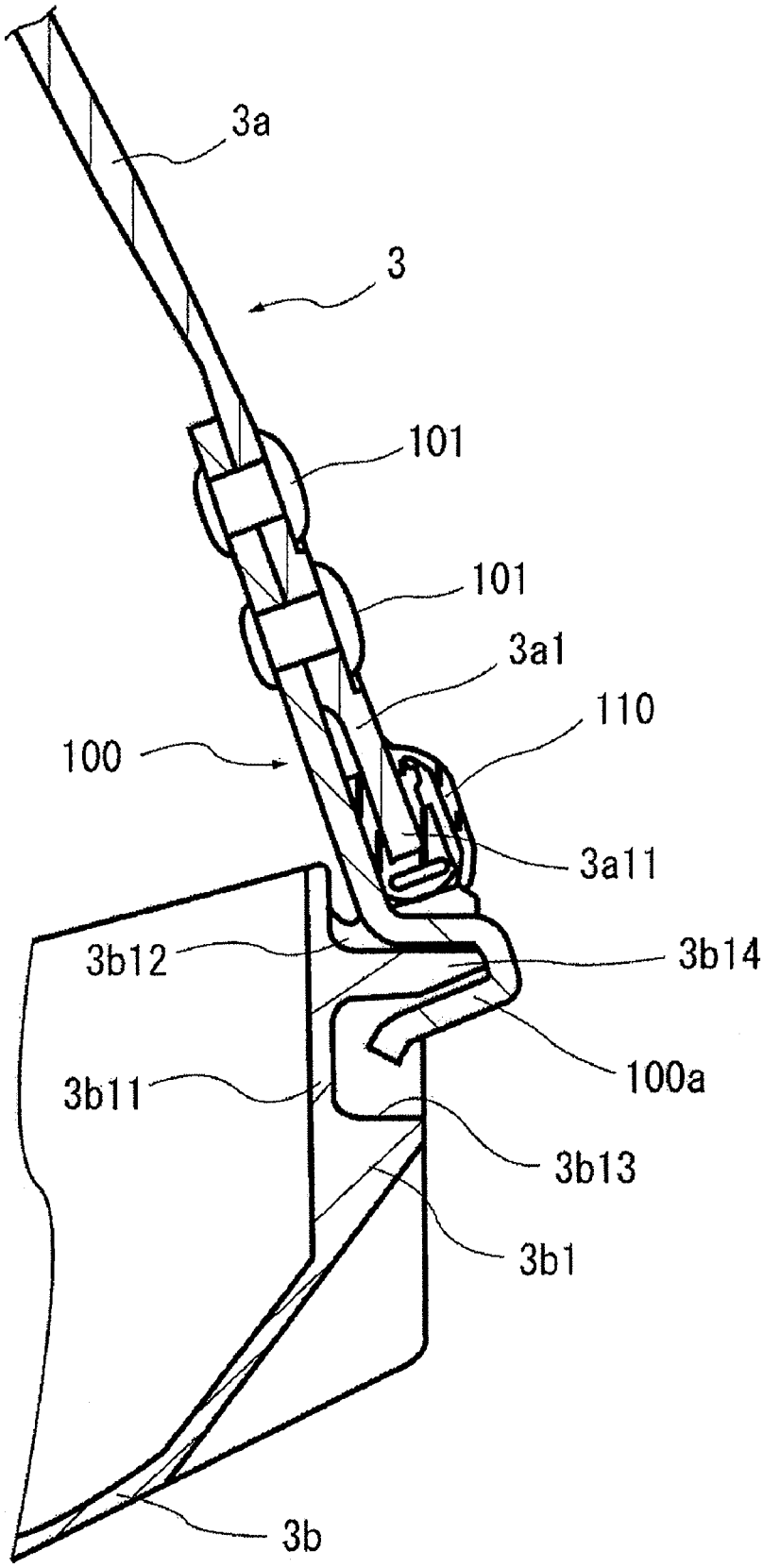

[FIG. 4]
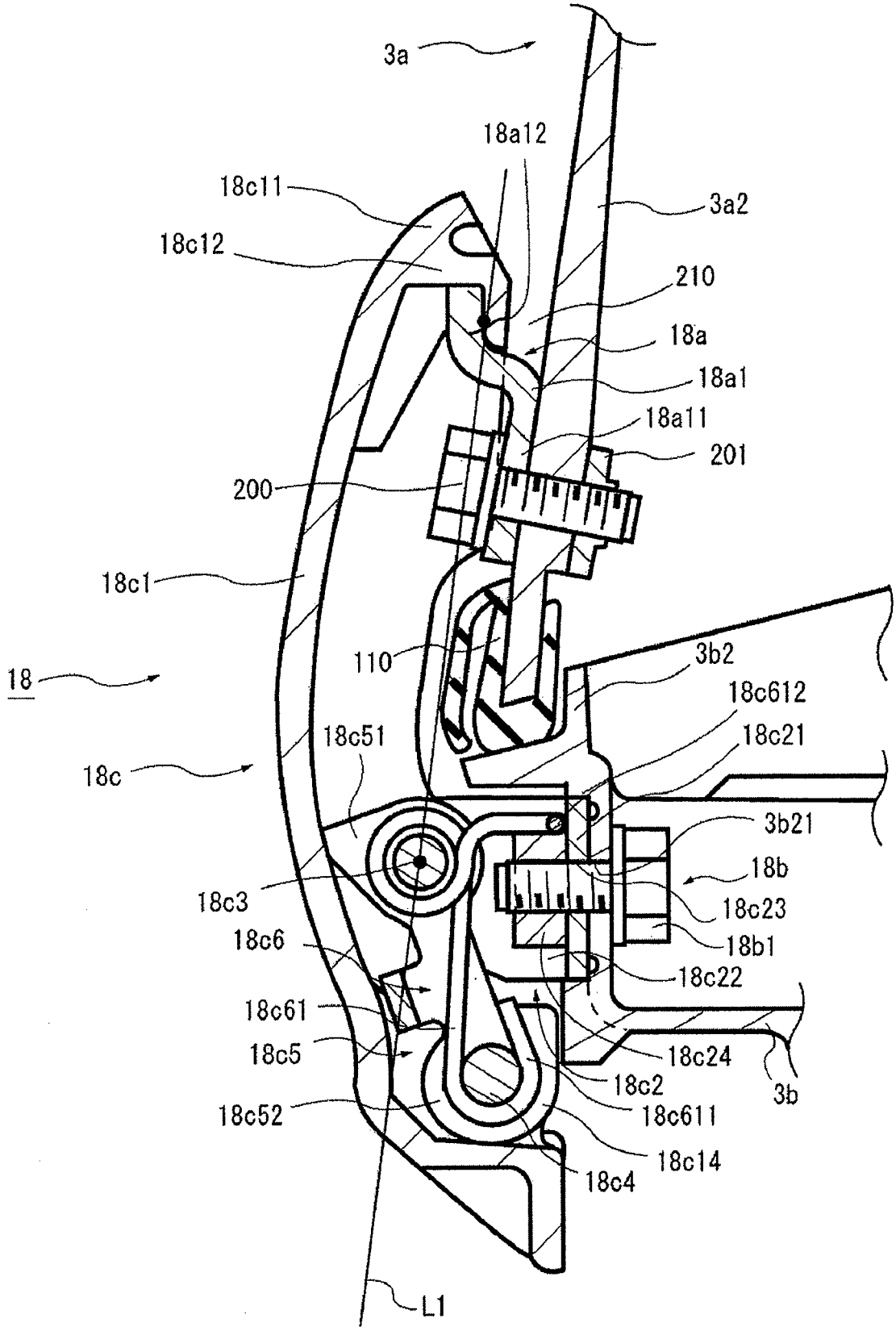

[FIG. 5]
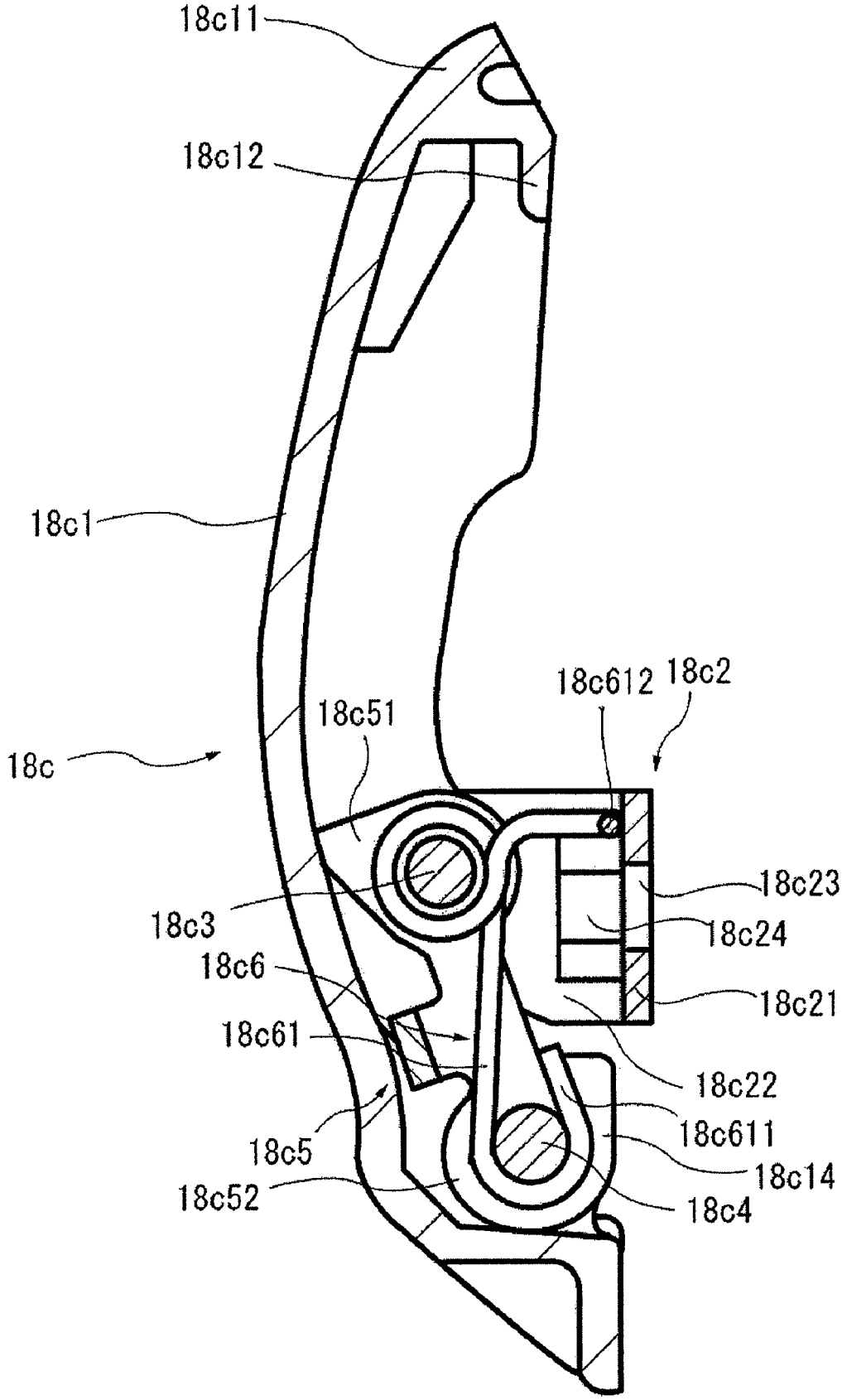

[FIG. 6]
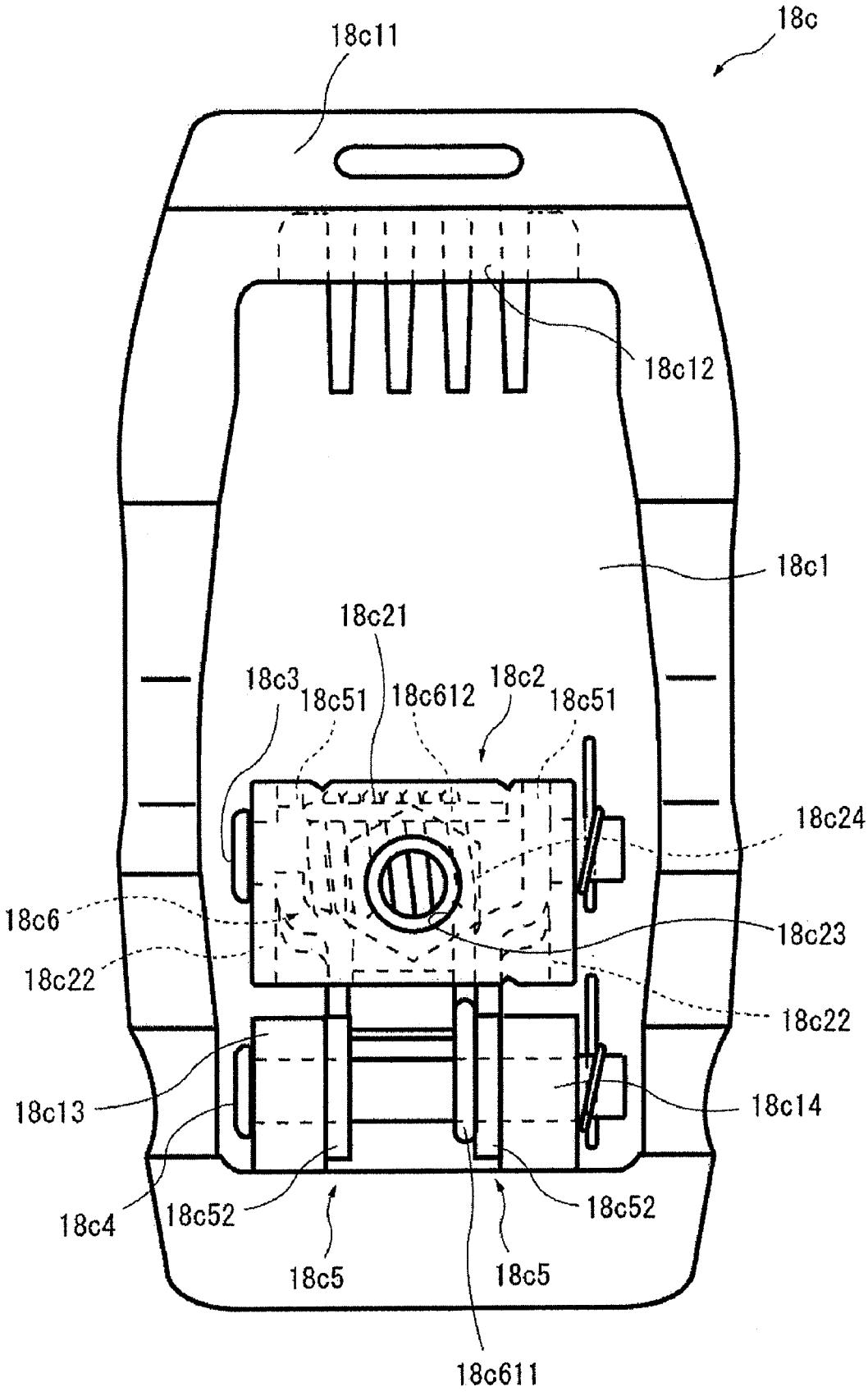

[FIG. 7]
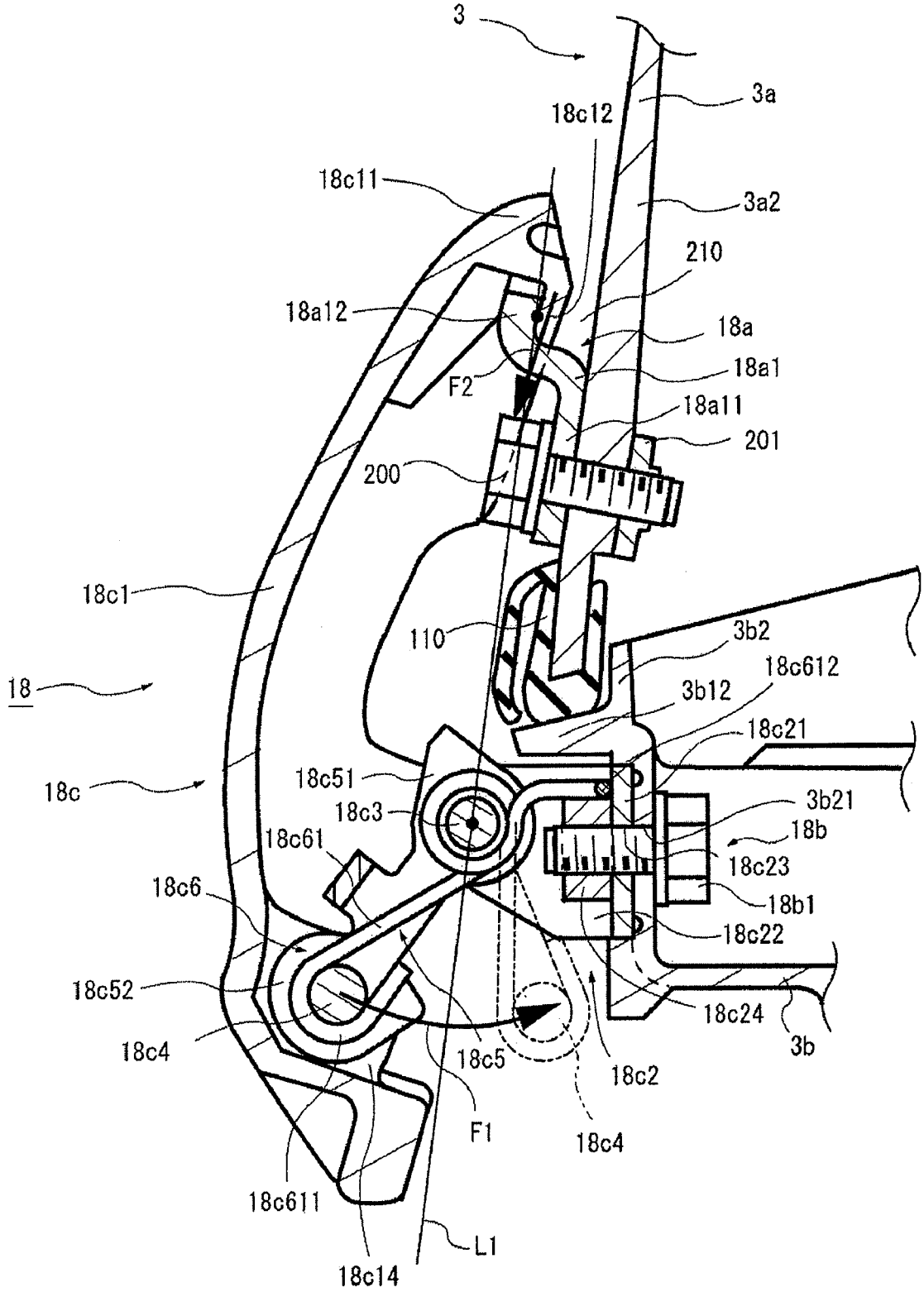

OUTBOARD MOTOR COWL STRUCTURE

CROSS-REFERENCE TO RELATED APPLICATIONS

The present application is based on and claims priority under 35 U.S.C. § 119 to Japanese Patent Application Serial No. 2006-111740, filed on Apr. 14, 2006, the entire contents of which are expressly incorporated by reference herein.

BACKGROUND OF THE INVENTION

1. Field of the Invention

The present invention relates to an outboard motor having a cowling comprising a top cowl and a bottom cowl that are detachably connectable to each other.

2. Description of the Related Art

In an outboard motor having a cowling in which a top cowl is detachably connected to a bottom cowl, various clamp apparatuses have been used. For example, one instance provides a clamp apparatus in which a stationary engaging member is installed to an inner side of a top cowl, and a clamp engaging member is adapted to engage with and disengage from the stationary engaging member by being rotated into and out of such engagement (See Japanese Publication No. JP 08-268384). As depicted in the publication, such a clamp apparatus tends to require a complex structure.

SUMMARY OF THE INVENTION

There is a need in the art for an outboard motor in which a top cowl and a bottom cowl can be connected and disconnected by a clamp apparatus having a simple structure but which still enables firm clamping.

In accordance with one embodiment, the present invention provides an outboard motor comprising a cowl having a top cowl, a bottom cowl, and a clamp apparatus for detachably connecting the top and bottom cowls. The clamp apparatus comprises a clamp engaging member formed on the top cowl, a clamp fixing member formed on the bottom cowl, and a clamp. The clamp has a main body, a fixing section, and a link extending between the main body and fixing section. The fixing section is connected to the clamp fixing member and has a mounting pivot. The main body comprises an engaging section and a supporting pivot. The engaging section is adapted to engage the clamp engaging member. The link has a first end and a second end. The first end of the link is rotatably connected to the mounting pivot. The second end of the link is rotatably connected to the supporting pivot. A closure line is defined through the engaging section and the mounting pivot. The clamp has an open state defined when the supporting pivot is on a side of the closure line opposite the cowl. The clamp has a closed state defined when the supporting pivot is on a side of the closure line adjacent the cowl. The clamp main body is biased toward the cowl when in the open state.

In another embodiment, the outboard motor additionally comprises a coil spring acting between the fixing section and the main body so as to bias the clamp main body toward the cowl when in the open state. In one such embodiment, the coil spring has a first end and a second end, the first end engaging the clamp main body, the second end engaging the fixing section. In a further embodiment, the coil spring is placed across the supporting pivot and the mounting pivot.

In yet another embodiment, the clamp apparatus is configured so that when the clamp is in the closed state, the clamp engaging section applies a generally downwardly directed force to the clamp engaging member. In one such embodiment, an elastic member is interposed between the top cowl and bottom cowl, and the elastic member is squeezed when the clamp is in the closed state.

In still another embodiment, the clamp is biased to maintain the clamp engaging section engaged with the clamp engaging member even when the clamp is in the open state.

BRIEF DESCRIPTION OF THE DRAWINGS

FIG. 1 shows a side view of an outboard motor in accordance with an embodiment.

FIG. 2 shows a plan view of the outboard motor of FIG. 1.

FIG. 3 shows a cross-sectional view illustrating an engaging and fixing portion of a front side of a top cowl and a bottom cowl.

FIG. 4 shows a cross-sectional view illustrating a closed clamp state on a rear side of a top cowl and a bottom cowl.

FIG. 5 shows a cross-sectional view of the clamp of FIG. 4.

FIG. 6 shows a front view of the clamp of FIG. 5.

FIG. 7 shows a cross-sectional view illustrating an opened clamp state on a rear side of a top cowl and a bottom cowl.

DETAILED DESCRIPTION OF PREFERRED EMBODIMENTS

The following description explains an embodiment of the present invention applied to an outboard motor. However, the present invention is not limited to this embodiment. In the embodiment, a front side of an outboard motor is referred to as a hull side, a rear side of an outboard motor as an opposite side of the hull side, and a perpendicular direction as a vertical direction.

As shown in FIG. 1 and FIG. 2, an embodiment of an outboard motor 1 preferably has a propulsion unit 2, and its housing section is formed with a cowl 3, an upper case 4, and a lower case 5. The cowl 3 in an upper position preferably houses a 4-cycle engine 10 with a crankshaft 10*a* positioned in a vertical direction, while the lower case 5 in a lower position has a propeller 6, which is driven by the 4-cycle engine 10. The engine 10 has the crankshaft 10*a* on a hull side, and has a cylinder 10*b* on the opposite side of the hull side. The upper case 4 in a middle section and the lower case 5 houses a power transmission mechanism 11 for transmitting the drive power of the engine 10 and an exhaust passage (not shown). By way of this power transmission mechanism 11, the engine 10 rotates the propeller 6. The power transmission mechanism 11 is formed with a drive shaft 12, a shift change mechanism 13, a propeller shaft 14, and other structures.

In the illustrated embodiment, the cowl 3 is composed of a top cowl 3*a* and a bottom cowl 3*b*, providing a space for an engine housing. On top of the upper case 4, there is an exhaust guide 15, which has the engine 10 fixed on its upper surface.

The bottom cowl 3*b* is fixed to a peripheral section on an upper surface of the exhaust guide 15 by a bolt. To a peripheral section on a bottom surface of the exhaust guide 15, a top end of the upper case 4 is fixed by a bolt. Around an upper section of the upper case 4 and the exhaust guide 15, an apron 17 is attached.

In the illustrated embodiment, the top cowl 3*a* covering an upper section of the engine 10 is attached for opening or closing on top of the bottom cowl 3*b*, which is fixed on the exhaust guide 15. A front section 3*a*1 of the top cowl 3*a* is engaged with a front section 3*b*1 of the bottom cowl 3*b*, and a rear section 3*a*2 of the top cowl 3*a* and a rear section 3*b*2 of the bottom cowl 3*b* are detachably connected with a clamp apparatus 18.

The outboard motor 1 preferably is mounted to a rear end of a hull 20, which has a stern plate 20*a* with a clamp bracket 21 fixed thereto. To this clamp bracket 21, a swivel bracket 22 is attached with a support of a tilt shaft 23 for rotation. To the swivel bracket 22, the propulsion unit 2 preferably is attached around a steering shaft 24 for rotation.

To an upper section of a front side of the propulsion unit 2, a bracket 31 preferably is fixed. To the bracket 31, a base end 30*a*1 of a handle housing 30*a* of a steering handle 30, preferably bent from a front to a rear in a shape of the letter L, is attached for vertical rotation. To a front end 30*b* of the handle housing 30*a*, a throttle grip 33 is rotatably disposed. To a section of the bracket 31 between a center of a front-rear direction of the outboard motor 1 and the steering handle 30, a shift lever 34, which preferably extends upward, is attached for rotation in a front-rear direction.

To an inner side of the handle housing 30*a*, a throttle friction adjuster 35 is attached for rotation. To a position in a rear section on an inner side of the handle housing 30*a*, a protruding section 30*d*, which is in a shape of the letter V in an overturned position protruding in a direction of an inner side at a certain angle, is formed. On a slope 30*e* on a side of the throttle friction adjuster 35 of the protruding section 30*d*, a stop switch 42 is disposed.

The outboard motor in the illustrated embodiment has the cowl 3 composed with the top cowl 3*a* and the bottom cowl 3*b*. Front sides of the top cowl 3*a* and the bottom cowl 3*b* preferably are connected as shown in FIG. 3, and rear sides of the top cowl 3*a* and the bottom cowl 3*b* can be detachably connected with aid of the clamp apparatus 18 as shown in FIG. 4 to FIG. 7. The following description explains an embodiment of a structure that enables such detachable connection.

As shown in FIG. 3, an elastic member 110 preferably is inserted from a lower direction and attached on an outer periphery of a bottom end 3*a*11 of the top cowl 3*a*, which elastic member 110 is placed under pressure in a closed clamp state. The elastic member 110 is contacted with a receiving surface 3*b*12 formed on an outer periphery of a top end 3*b*11 of the bottom cowl 3*b*, and functions as a secure seal because of an elastic deformation. In a preferred embodiment, the elastic member 110 is made of rubber. However, other materials that can elastically deform, such as resin, can also be used. The present elastic member 110 is attached to an outer periphery of the bottom end 3*a*11 of the top cowl 3*a*. However, in other embodiments, the elastic member 110 may be attached to an outer periphery of the top end 3*b*11 of the bottom cowl 3*b*.

In the front section 3*b*1 of the bottom cowl 3*b*, a recess section 3*b*13 preferably is formed. From the recess section 3*b*13, an engaging projection 3*b*14 extends outward. In a section where the engaging projection 3*b*14 is positioned, the receiving surface 3*b* 12 is formed uncovered.

To an inside of the front section 3*a*1 of the top cowl 3*a*, an engaging arm 100 is attached and fixed with rivets 101. On the engaging arm 100, an engaging hook 100*a* is formed. The engaging hook 100*a* preferably is in a position lower than the bottom end 3*a*11 of the front section 3*a*1 of the top cowl 3*a*, and the engaging hook 100*a* is selectively engaged with the engaging projection 3*b*14 and held.

The following description explains an embodiment of the clamp apparatus 18 with reference to FIG. 4 to FIG. 7. The clamp apparatus 18 preferably has a clamp engaging member 18*a*, a clamp fixing member 18*b*, and a clamp 18*c*, and detachably connects the rear section 3*a*2 of the top cowl 3*a* with the rear section 3*b*2 of the bottom cowl 3*b*.

The clamp engaging member 18*a* preferably has a plate 18*a*1. A base section 18*a*11 is attached to the rear section 3*a*2 of the top cowl 3*a*, and fastened and fixed by a bolt 200 and a nut 201. From the base section 18*a*11, a clamp engaging section 18*a*12 rises up and extends upward. Between the clamp engaging section 18*a*12 and an outside of the rear section 3*a*2 of the top cowl 3*a*, an engaging space 210 is formed.

A clamp fixing member 18*b* preferably has a bolt 18*b*1. The bolt 18*b*1 is inserted from a bolt hole 3*b*21 formed in the rear section 3*b*2 of the bottom cowl 3*b*, and fastens and fixes the clamp 18*c*. However, in other embodiments, the clamp fixing member 18*b* is not limited to the illustrated bolt 18*b*1, but can also comprise other fasteners such as a rivet, an adhesive member, and the like.

The clamp 18*c* has a structure that enables a connection and a disconnection of the top cowl 3*a* and the bottom cowl 3*b*, and comprises a clamp main body 18*c*1, a fixing section 18*c*2, a mounting pivot 18*c*3, a supporting pivot 18*c*4, links 18*c*5, and a biasing means 18*c*6. The clamp main body 18*c*1 preferably is made of metal, reinforced resin, or the like, and has an engaging section 18*c*12 on a top cowl side 18*c*11 for engaging with the clamp engaging section 18*a*12.

The fixing section 18*c*2 preferably is made of metal, reinforced resin, or the like, and has a fixing member 18*c*21 and a pair of ribs 18*c*22 standing on both sides of the fixing member 18*c*21. The fixing member 18*c*21 has a fixing hole 18*c*23 in a center section, and, in an inside of it, has a nut 18*c*24 fixed in a position corresponding to the fixing hole 18*c*23. The fixing member 18*c*21 of the fixing section 18*c*2 is attached to an outer surface of the rear section 3*b*2 of the bottom cowl 3*b*; and the bolt 18*b*1 is inserted from an inside of the bottom cowl 3*b* through the bolt hole 3*b*21 formed in a rear section 3*b*2 of the bottom cowl 3*b* into the nut 18*c*24 through the fixing hole 18*c*23, and fastened and fixed. It is to be understood that other embodiments may employ other structure for connecting the fixing section to the bottom cowl 3*b*.

The illustrated mounting pivot 18*c*3 connects a pair of base sections 18*c*51 of the links 18*c*5 and the pair of ribs 18*c*22 of the fixing section 18*c*2 for rotation. A pair of end sections 18*c*52 of the links 18*c*5 and the clamp main body 18*c*1 are connected via a supporting pivot 18*c*4 for rotation. The supporting pivot 18*c*4 preferably is supported by a pair of bosses 18*c*13 and 18*c*14 integrally formed in the clamp main body 18*c*. Between the pair of bosses 18*c*13 and 18*c*14, the pair of the end sections 18*c*52 of the links 18*c*5 are rotatably supported by the supporting pivot 18*c*4. The pair of base sections 18*c*51 of the links 18*c*5 are rotatably supported by the mounting pivot 18*c*3 inside the pair of ribs 18*c*22.

Between the pair of base sections 18*c*51 of the links 18*c*5 and the pair of end sections 18*c*52, a coil spring 18*c*61 functioning as the biasing means 18*c*6 is disposed. The coil spring 18*c*61 preferably is placed across the mounting pivot 18*c*3 and the supporting pivot 18*c*4. One end 18*c*611 of the coil spring 18*c*61 is on the supporting pivot 18*c*4, and the other end 18*c*612 is on the fixing member 18*c*21 of the fixing section 18*c*2. The clamp main body 18*c*1 is biased in adjacent to the cowl 3 especially in an open clamp state.

In the embodiment shown in FIG. 7, the engaging section 18*c*12 of the clamp main body 18*c* 1 is in a position providing for the engaging space 210, and is engaged with the clamp engaging section 18*a*12 of the rear section 3*a*2 of the top cowl 3*a*. To close the clamp, the clamp main body 18*c*1 is pushed downward in a direction of the rear section 3*b*2 of the bottom cowl 3*b*. The coil spring 18*c*61 preferably provides biasing force F1 to assist such closure. Simultaneously, another force F2, which engages the engaging section 18c12 of the clamp main body 18c1 with the clamp engaging section 18a12 of the top cowl 3a, is generated. As a result, the clamp main body 18c1 is placed as a closed clamp as shown in FIG. 4.

When a state of the clamp main body 18c1 is changed from an open clamp state to a closed clamp state, the elastic member 110, which is positioned in a place that detachably connects the top cowl 3a and the bottom cowl 3b, is squeezed to the receiving surface 3b12 formed on an outer periphery of the top end 3b11 of the bottom cowl 3b, causing an elastic deformation, and functioning as a secure seal. When a state of the clamp main body 18c1 is changed from an open clamp state to a closed clamp state, the elastic member 110 is pressed. Therefore, the supporting pivot 18c4 is positioned adjacent to the cowl 3 inside of a line L1 connecting the engaging section 18c12 and the mounting pivot 18c3. As a result, an effective clamp is realized smoothly and surely.

In the illustrated embodiment, the coil spring 18c61 forming the biasing means 18c6 moves the supporting pivot 18c4 in a position away from the cowl 3 beyond the line L1 connecting the engaging section 18c 12 and the mounting pivot 18c3 when in an open clamp state as shown in FIG. 7, and moves the supporting pivot 18c4 in a position adjacent to the cowl 3 within the line L1 connecting the engaging section 18c12 and the mounting pivot 18c3 when in a closed clamp state as shown in FIG. 4. In a case where the supporting pivot 18c4 is positioned in a place away from the line L1 connecting the engaging section 18c12 and the mounting pivot 18c3 in a direction which is farther from the cowl 3 as shown in FIG. 7, when a state of the clamp main body 18c1 is turned from a closed clamp state to an open clamp state, the coil spring 18c61 provides biasing force F1 for forcing the clamp main body 18c1 to come in adjacent to the cowl 3, thus preventing disconnection of the top and bottom cowls.

During operation, there may be occasions when, for example, a piece of driftwood or the like collides with the outboard motor 1 while the boat is traveling. Its impact may cause inertial force which urges the top cowl 3a upward away from the bottom cowl 3b, and force may be communicated to the clamp main body 18c1 sufficient to cause a closed clamp to open. As such, this may move the supporting pivot 18c4 to a place away outside of the line L1 connecting the engaging section 18c12 and the mounting pivot 18c3 in a direction which is farther from the cowl 3 as shown in FIG. 7, and a state of the clamp main body 18c1 may be momentarily changed from a closed clamp state to an open clamp state. However, the coil spring 18c61 gives the biasing force F1, which urges the clamp main body 18c1 in a direction closer to the cowl 3, and such force generated by the coil spring 18c61 prevents the clamp from opening fully. Therefore, the simple structure realizes a firm clamping even in dynamic and impact conditions.

Even when the clamp main body 18c1 is in an open clamp state as shown in FIG. 7, the coil spring 18c61 still biases the clamp main body 18c1 to come in adjacent to the cowl 3 by the biasing force F1 during such an open clamp state. The engaging section 18c12 of the clamp main body 18c1 thus is still made to engage with the clamp engaging section 18a12 of the top cowl 3a with the force F2, so that the engaging section 18c12 of the clamp main body 18c1 is engaged with the clamp engaging section 18a12 of the rear section 3a2 of the top cowl 3a, and is not released. As a result, even when the clamp main body 18c1 is in an open or partially open clamp state, the top cowl 3a is not released from the bottom cowl 3b.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a cowl having a top cowl, a bottom cowl, and a clamp apparatus for detachably connecting the top and bottom cowls, the clamp apparatus comprising a clamp engaging member formed on the top cowl, a clamp fixing member formed on the bottom cowl, and a clamp having a main body, a fixing section, and a link extending between the main body and fixing section, the fixing section connected to the clamp fixing member and having a mounting pivot, the main body comprising an engaging section and a supporting pivot, the engaging section adapted to engage the clamp engaging member, the link having a first end and a second end, the first end of the link being rotatably connected to the mounting pivot, the second end of the link being rotatably connected to the supporting pivot, wherein a closure line is defined through the engaging section and the mounting pivot, the clamp having an open state defined when the supporting pivot is on a side of the closure line opposite the cowl, the clamp having a closed state defined when the supporting pivot is on a side of the closure line adjacent the cowl, and the clamp main body is biased toward the cowl when in the open state.

2. An outboard motor as in claim 1 additionally comprising a coil spring acting between the fixing section and the main body so as to bias the clamp main body toward the cowl when in the open state.

3. An outboard motor as in claim 2, wherein the coil spring has a first end and a second end, the first end engaging the clamp main body, the second end engaging the fixing section.

4. An outboard motor as in claim 3, wherein the coil spring is placed across the supporting pivot and the mounting pivot.

5. An outboard motor as in claim 4, wherein the clamp apparatus is configured so that when the clamp is in the closed state, the clamp engaging section applies a generally downwardly directed force to the clamp engaging member.

6. An outboard motor as in claim 5, wherein an elastic member is interposed between the top cowl and bottom cowl, and the elastic member is squeezed when the clamp is in the closed state.

7. An outboard motor as in claim 1, wherein the clamp apparatus is configured so that when the clamp is in the closed state, the clamp engaging section applies a generally downwardly directed force to the clamp engaging member.

8. An outboard motor as in claim 7, wherein an elastic member is interposed between the top cowl and bottom cowl, and the elastic member is squeezed when the clamp is in the closed state.

9. An outboard motor as in claim 1, wherein the clamp is biased to maintain the clamp engaging section engaged with the clamp engaging member even when the clamp is in the open state.

* * * * *